US006079084A

United States Patent [19]

Gwynn

[11] Patent Number: 6,079,084

[45] Date of Patent: Jun. 27, 2000

[54] METHOD AND APPARATUS FOR REMOVING AND REPLACING A WIPER BLADE ASSEMBLY AND A CORONA GRID IN A TONER CARTRIDGE

[75] Inventor: Raymond L. Gwynn, Simi Valley, Calif.

[73] Assignee: Nu-kote International, Inc., Franklin, Tenn.

[21] Appl. No.: 09/173,772

[22] Filed: Oct. 16, 1998

Related U.S. Application Data

[60] Provisional application No. 60/062,524, Oct. 17, 1997.

[51] Int. Cl.[7] ..... A44B 17/00; B42F 1/00

[52] U.S. Cl. ..... 24/350; 24/295; 24/336; 24/563

[58] Field of Search ..... 24/350, 335, 336, 24/563, 458, 545, 67.9; 399/351

[56] References Cited

U.S. PATENT DOCUMENTS

| | | | |
|---|---|---|---|
| 1,913,864 | 6/1933 | Walper | 24/350 |
| 2,306,975 | 12/1942 | Pender | 24/295 |
| 2,467,604 | 4/1949 | Tinnerman et al. | 24/563 |
| 2,794,215 | 6/1957 | Dayvault, Sr. | 24/563 |
| 3,231,075 | 1/1966 | Ivanhoe | 24/563 |
| 3,392,668 | 7/1968 | Young et al. | 24/563 |
| 4,710,992 | 12/1987 | Falwell et al. | 24/545 |
| 4,908,915 | 3/1990 | Ruggles et al. | 24/336 |
| 4,946,065 | 8/1990 | Goulter et al. | 24/563 |
| 5,136,333 | 8/1992 | Craft et al. . | |
| 5,365,315 | 11/1994 | Baker et al. . | |

FOREIGN PATENT DOCUMENTS

| | | | |
|---|---|---|---|
| 0807721 | 1/1959 | United Kingdom | 24/563 |

*Primary Examiner*—Victor N. Sakran

*Attorney, Agent, or Firm*—Fay, Sharpe, Fagan, Minnich & McKee, LLP

[57] ABSTRACT

A method and apparatus for the removal and replacement of a wiper blade assembly in a toner cartridge wherein a first end of the wiper blade includes a projection or "tab" that is captured in a slot formed in the sidewall of the toner cartridge housing. The slot in the sidewall has a forward edge, a rear edge, an upper region, and a lower region. The method includes forming a first cut through the cartridge sidewall from a forward edge of the sidewall to the upper region of the slot. A second cut is made through the sidewall from the forward edge to the lower region of the slot. A waste section of the sidewall defined by the first and second cuts, the sidewall forward edge, and the slot is removed and discarded. The first end of the wiper blade assembly is moved forward, away from slot rear edge, and is pulled upwardly and out of the waste toner hopper region of the cartridge. A replacement wiper blade assembly is operatively positioned in place of the original wiper blade assembly with a tab portion positioned adjacent the edge of the sidewall formerly defining the slot rear edge. The replacement wiper blade assembly is secured to the housing using a special retaining clip. This clip includes a first projection that engages the wiper blade assembly and at least one second projection that engages the cartridge sidewall when the clip is installed.

7 Claims, 6 Drawing Sheets

METHOD AND APPARATUS FOR REMOVING AND REPLACING A WIPER BLADE ASSEMBLY AND A CORONA GRID IN A TONER CARTRIDGE

CROSS-REFERENCE TO RELATED APPLICATION

This application claims priority from U.S. provisional application Ser. No. 60/062,524 filed Oct. 17, 1997.

BACKGROUND OF THE INVENTION

The present invention relates to toner cartridges and the remanufacture thereof. More particularly, it relates to a retaining clip for a toner cartridge wiper blade assembly, a replacement fastener for a corona grid assembly, and a method for removing and replacing a toner cartridge wiper blade assembly and a corona grid assembly.

Toner "process " cartridges are well known. Such cartridges, commonly referred to simply as toner cartridges, are used in laser beam printers, facsimile machines, electrophotographic copying machines, and other such apparatus to form an image on a piece of paper or other suitable image recording media. In such image forming apparatus, a latent image is formed by selectively exposing a rotating photosensitive drum which has been uniformly charged. Toner is then transferred to the photosensitive drum to form a toner image on the drum. A recording sheet, most commonly paper, is then contacted with the drum so that the toner image is transferred to the sheet for viewing. Finally, a wiper blade contacts the drum and removes any excess toner so that another latent image may be formed on the drum. The wiper blade sweeps the residual toner into a waste toner hopper.

It is also well known to recharge or remanufacture toner cartridges upon the depletion of the original supply of toner. The cartridge housing and many other components are long-lasting and need not be discarded simply due to the depletion of toner. Other components, however, are worn as the toner is depleted and must be replaced when the toner hopper is refilled. Depending upon the type of toner cartridge involved, various methods are used to access the toner hopper and cartridge components for recharging purposes.

It is often necessary to replace the cartridge wiper blade assembly during a recharging operation. Unfortunately, with certain cartridges, removal of the original equipment wiper blade assembly, and the subsequent insertion of a new blade assembly, is very troublesome. For example, in certain cartridges, the wiper blade assembly is positioned in a rear or waste toner hopper region of the cartridge housing. Heretofore, removal of the wiper blade in these cartridges has necessitated removal and subsequent reattachment of the top of the toner waste hopper which has proved to be a difficult and time consuming process. Attempts to replace the wiper blade assembly in these cartridges without removing the waste toner hopper top oftentimes results in damage to the toner cartridge housing. Furthermore, given that toner cartridges are typically recharged numerous times, it is generally desirable to use a method of wiper blade replacement that is quick and easy, yet sufficiently secure to prevent any unwanted movement of the wiper blade assembly.

The wiper blade replacement can be further complicated by the presence of a corona wire grid which blocks convenient access to the wiper blade assembly. If removed, the corona grid must be reattached to the cartridge housing using very small fasteners which are extremely difficult to manipulate and handle.

Accordingly, it has been considered desirable to develop a method for replacing a wiper blade assembly in the above-described types of toner cartridges, along with a device for releasably retaining the replacement wiper blade assembly for ease of subsequent replacement operations. Furthermore, it has been deemed desirable to develop a method and apparatus for securing a corona grid in these cartridges after the same has been removed to facilitate wiper blade removal and replacement.

The subject invention is deemed to meet the foregoing needs and others, and to provide apparatus and methods suitable for use with these particular cartridges.

SUMMARY OF THE INVENTION

The present development provides for the removal and replacement of a wiper blade assembly in a toner cartridge of the type wherein at least a first end of the wiper blade includes a projection or "tab" that is captured in a slot formed in the sidewall of the toner cartridge housing. The slot in the sidewall has a forward edge, a rear edge, an upper region, and a lower region. The method includes forming a first cut through the cartridge sidewall from a forward edge of the sidewall to the upper region of the slot. A second cut is made through the sidewall from the forward edge to the lower region of the slot. A waste section of the sidewall defined by the first and second cuts, the sidewall forward edge, and the slot is removed and discarded. The first end of the wiper blade assembly is moved forward, away from slot rear edge, and is pulled upwardly and out of the waste toner hopper region of the cartridge. A replacement wiper blade assembly is operatively positioned in place of the original wiper blade assembly with a tab portion positioned adjacent the edge of the sidewall formerly defining the slot rear edge. The replacement wiper blade assembly is secured to the housing using a special retaining clip. This clip includes a first projection that engages the wiper blade assembly and at least one second projection that engages the cartridge sidewall when the clip is installed.

A wiper blade assembly retaining clip formed in accordance with the present development has a generally U-shaped conformation and includes a base defining a planar inner surface for lying adjacent the cartridge sidewall. A wiper blade assembly engaging projection extends from a first end of the inner surface and includes a lateral blade assembly engaging surface. A sidewall engaging projection is spaced from the blade engaging projection and extends from a second end of the clip inner surface. The sidewall engaging projection includes one or more lances or bite-teeth with edges oriented toward the base wall inner surface. The bite-teeth are adapted to engage the cartridge sidewall and resist accidental disengagement of the clip from the sidewall. A third sidewall engaging projection extends from an upper edge of the base member to facilitate proper clip positioning.

In accordance with another aspect of the invention, the toner cartridge includes a corona grid which is removed to facilitate access to and removal of the wiper blade assembly. Once the wiper blade assembly is replaced and secured in position with a retaining clip in accordance with the present invention, the corona grid is repositioned and connected to the cartridge housing through advantageous use of a plurality of new and improved fasteners. Each of these fasteners comprises a lower body portion for insertion through an aperture in the grid assembly into an aligned bore formed in the cartridge housing itself. Preferably, an adhesive is used to retain the fastener body securely in the housing bore. The fastener includes a radially enlarged flange which has a diameter greater than the diameter of each attachment aperture formed in the corona grid so that the flange is adapted to engage the grid upper surface and exert a downward force thereon when the fastener is forced into and adhesively secured in the associated housing bore. A gripping projection, such as a shaft, extends upward from the flange to provide a gripping point so that the fastener is easily insertable through the grid aperture and into the cartridge housing bore. Once the body of the fastener is adhesively or otherwise secured in the housing bore and the grid once again securely connected to the cartridge housing, the projection is cut or otherwise disconnected from the fastener, preferably flush with the upper surface of the flange, to prevent interference with the nearby rotating photosensitive drum.

BRIEF DESCRIPTION OF THE DRAWINGS

The invention may take physical form in certain parts and arrangements of parts, and may be carried out in certain steps and arrangements of steps, preferred embodiments of which will be described in detail in this specification and illustrated in the accompanying drawings which form a part hereof and wherein.

DETAILED DESCRIPTION OF THE INVENTION

Figure 1:
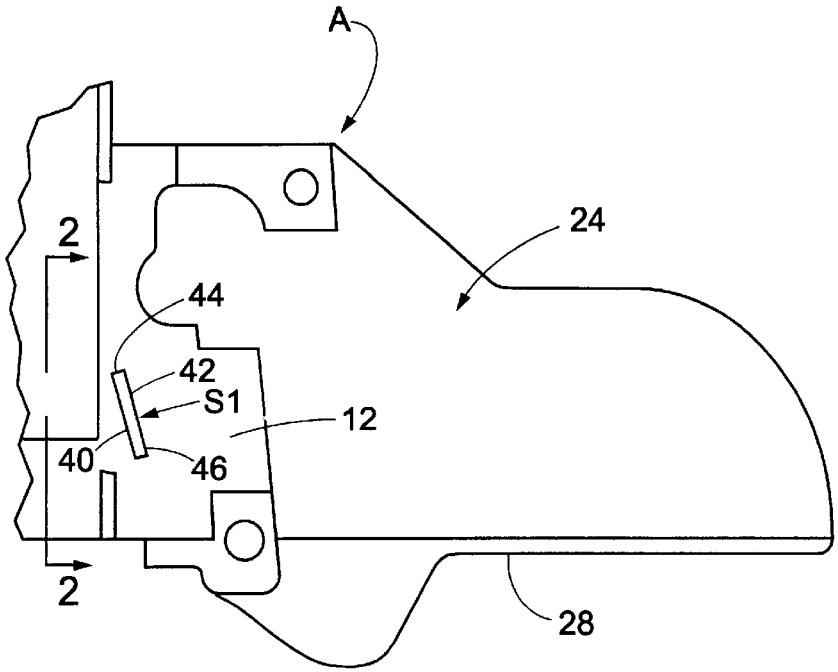
FIG. 1 is a simplified partial side elevational view of a toner cartridge.
Figure 2:
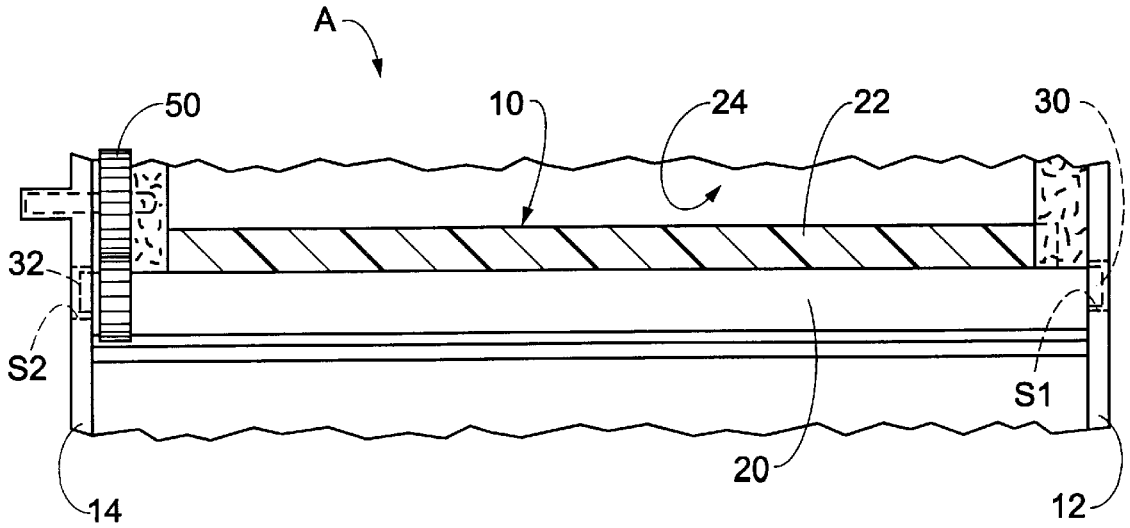
FIG. 2 is a cross-sectional view taken along line 2—2 of FIG. 1 for illustrating an original equipment wiper blade assembly and its connection to the toner cartridge.

Referring now to the drawings wherein the showings are for purposes of illustrating preferred embodiments of the invention only and not for limiting the same, FIGS. 1 and 2 illustrate a waste toner hopper region A of a toner cartridge, in particular, a toner cartridge constructed in accordance with well known and commonly available types such as those designated as IBM 4039 and 4049 cartridges. Those skilled in the art will recognize that the waste toner hopper region, as illustrated herein, is inverted from its operative position in an image forming apparatus. However, the illustrated orientation of the waste toner hopper region A facilitates replacement of the wiper blade assembly in accordance with the present invention.

Figure 3:
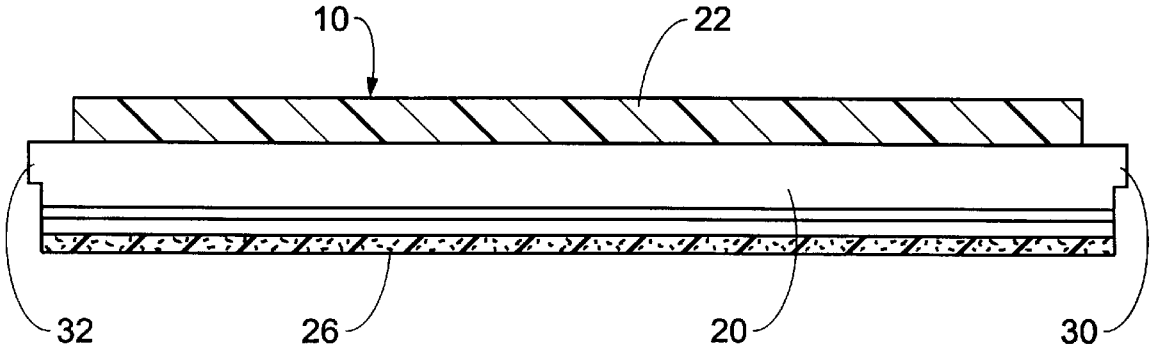
FIG. 3 is a front elevational view of a wiper blade assembly.

With particular reference to FIGS. 2 and 3, a wiper blade assembly 10 extends laterally across the cartridge region A between first and second sidewalls 12,14. The assembly preferably includes a metallic base member 20 and a resilient plastic wiper blade 22 connected thereto. As is known in the art, the resilient plastic wiper blade contacts the photosensitive drum (not shown) and wipes excess toner therefrom into a waste toner hopper 24 (FIG. 1). The base member 20 includes foam or other gasket material 26 at least partially around its periphery of and includes first and second tabs 30,32 extending from opposite lateral sides thereof. The tabs 30,32 are received and captured in slots S1,S2 formed in the cartridge sidewalls 12,14 respectively. It can be seen in FIG. 1 that the slot S1 is defined in the wall 12 to include a forward edge region 40, a rear edge region 42, an upper region 44, and a lower region 46. The slot S2 is similarly defined in the sidewall 14.

Removal and replacement of the wiper blade assembly 10 requires that the tabs 30,32 be disengaged from their respective slots S1,S2. However, certain cartridges, including the IBM 4039 and 4049 cartridges and others, are constructed so that the tabs 30,32 are not easily removed from the slots S1,S2. The plastic sidewalls S1,S2 are rigid and not easily spread relative to each other without damaging the cartridge itself. Furthermore, as shown in FIG. 2, one or more gears 50 and other cartridge components lie adjacent the cartridge sidewall 14 and thus limit access to the slot S2 and the tab 32 captured therein. Accordingly, with such cartridges, it has heretofore been common practice to remove the waste toner hopper cover 28 to provide better access to the blade assembly 10 for its removal and replacement. However, the cover removal, and its subsequent reattachment, comprise time consuming operations. Furthermore, removal and reattachment of the cover 28 increases the risk of waste toner leakage between the hopper 24 and the cover 28.

Figure 4:
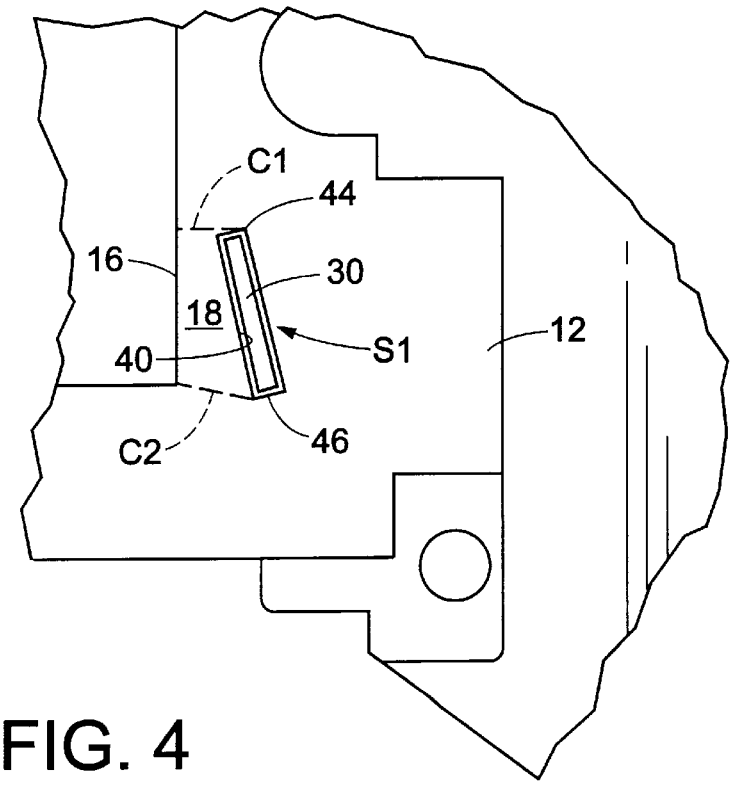
FIG. 4 is a greatly enlarged, partial side elevational view of the cartridge of FIG. 1.

The present invention provides a new and improved method of removing the wiper blade assembly 10 from the cartridge and reattaching a replacement blade assembly in its place. According to the invention, and as is shown in FIG. 4, first and second cuts C1,C2 are made through the sidewall 12, from a forward edge 16 thereof to the upper and lower slot regions 44,46, respectively. The cuts C1,C2, together with the sidewall forward edge 16 and the slot forward edge 40 and upper region 44, define a waste region 18 of the sidewall 12 which is removed and discarded so that the cartridge appears as illustrated in FIG. 5.

Figure 5:
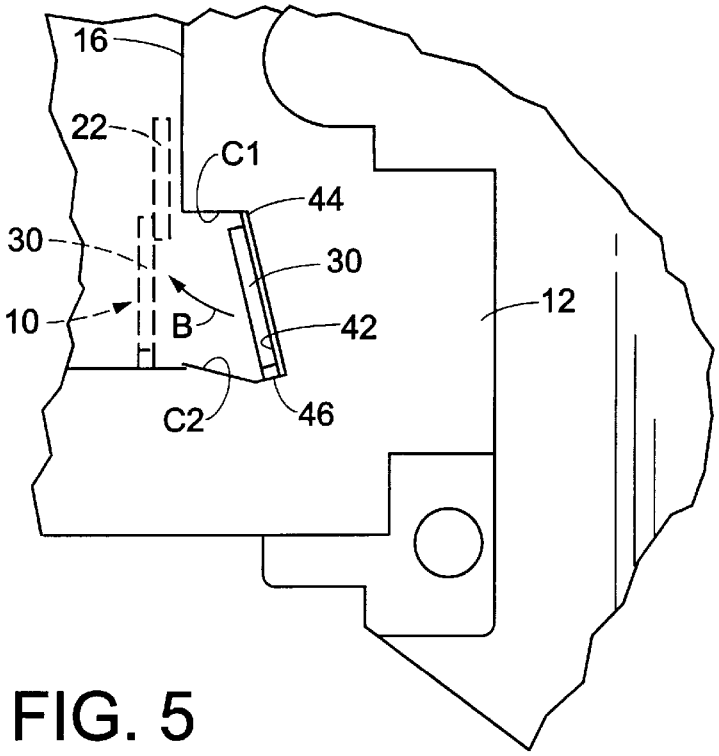
FIGS. 5–7 are greatly enlarged, partial side elevational views of the cartridge of FIG. 1, showing progressive stages of removing the wiper blade assembly and subsequent replacement in accordance with the present invention.

With continuing reference to FIG. 5, after the waste region 18 is discarded, the wiper blade assembly 10 is removed from the cartridge A by first pulling the tab 30 upwardly and forwardly (away from the waste hopper 24) as illustrated by the arrow B. Once the assembly 10 is positioned as is shown in dotted lines, an upward and lateral pulling force (away from the sidewall 14) is exerted thereon so that the tab 32 is pulled from the slot S2. Once both tabs 30,32 are freed from their respective slots S1,S2, the wiper blade assembly 10 is easily removed from the toner cartridge.

Figure 6:
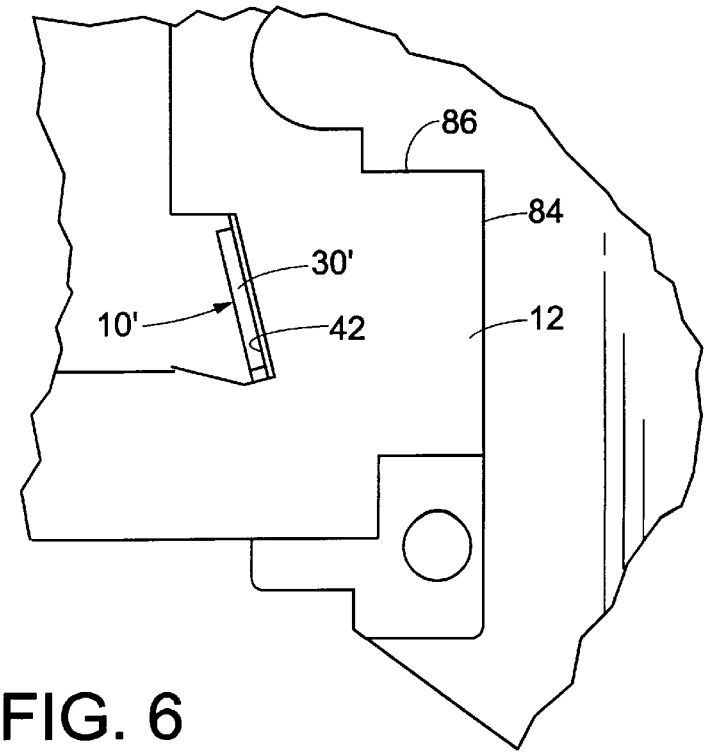
Figure 7:
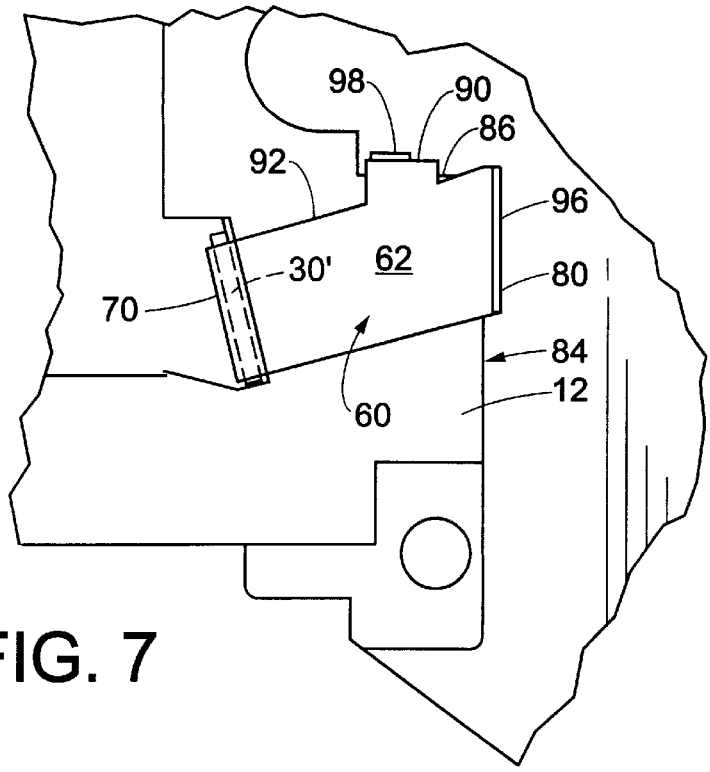

Referring now to FIGS. 6 and 7, a replacement wiper blade assembly 10' (having the same or a similar structure as the assembly 10 shown in FIG. 3) is inserted into the waste hopper region of the cartridge A in accordance with the reverse of the above-describe blade assembly removal steps. Like components of the assembly 10' relative to the blade assembly 10 are illustrated with like reference numerals having a primed (') suffix for ease of appreciating the invention. Once the blade assembly 10' is reinserted into the waste hopper region A of the cartridge, a tab 30' of the assembly 10' lies adjacent the sidewall edge 42 previously forming the rear edge of the slot S1. Thereafter, a retaining clip 60 formed in accordance with the present invention is used to retain the replacement wiper blade assembly 10' in the operative position shown in FIGS. 6 and 7.

Figure 8A:
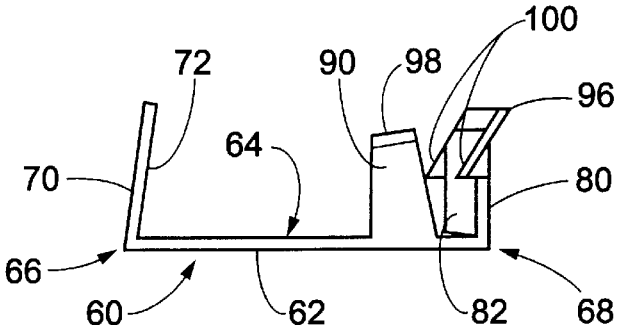
FIGS. 8A and B, respectively, illustrate a top plan view and a front elevational view of a wiper blade retaining clip formed in accordance with the present invention.
Figure 8B:
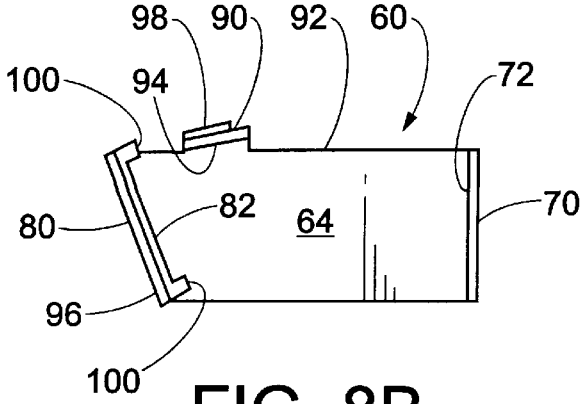

Retaining clip 60 is best shown in FIGS. 7–8B and comprises a base member 62 including a planar inner surface 64. When the clip is installed as illustrated in FIG. 7, the planar inner surface 64 lies adjacent the sidewall 12. A first projection 70 extends from the inner surface 64 at a clip first end 66 and includes a lateral blade assembly engaging surface 72 that engages and lies adjacent the tab 30'. A second projection 80 extends from the inner surface 64, preferably at an opposite second clip end 68 relative to the projection 70, and defines a sidewall engaging surface 82 that engages and lies adjacent a portion of the sidewall 12 when the clip is installed. The sidewall 12 of the toner cartridge includes a vertical, laterally extending surface 84 which is well-suited for engagement by the projection 80 in the manner shown in FIG. 7.

The clip 60 is preferably made from a resilient metal such as steel or is formed of a suitable plastic. Preferably, the projections 70,80 are biased slightly inward toward each other and must be spread for purposes of clip installation. As such, the clip tightly engages the tab 30' and the cartridge surface 84 when properly installed. Furthermore, as shown, the clip surface 82 is inclined so that the clip is positioned diagonally as shown in FIG. 7. Such arrangement is particularly well-suited for the IBM 4039 and 4049 toner cartridges.

The sidewall 12 of the cartridge also includes a horizontal surface 86 connected to the surface 84. The clip 60, therefore, preferably includes a third projection 90 extending from the inner surface 64 at a clip top edge 92 between the first and second projections 70,80. The projection 90 includes a horizontal sidewall engaging surface 94 that engages the horizontal sidewall surface 86 to ensure the proper vertical location of the installed clip. Also, the projection 90 allows the clip 60 to be installed in only one orientation, thereby preventing accidental reverse installation thereof.

To facilitate installation and removal of the clip, each of projections 80,90 includes a distal chamfer, bevel, or outwardly turned portion 96,98, respectively. Also, to prevent the accidental disengagement of the clip from the sidewall 12, at least the projection 80 includes at least one inwardly directed lance or bite-tooth 100. As best seen in FIG. 8A, the bite-teeth are oriented toward the base member inner surface 64 so that clip installation is not unduly impeded. However, clip disengagement from the sidewall requires that the clip be spread so that the teeth 100 disengage the sidewall surface 84. The chamfered surfaces 96,98 also facilitate clip removal by providing a hand or tool insertion point during clip spreading operations.

Figure 9:
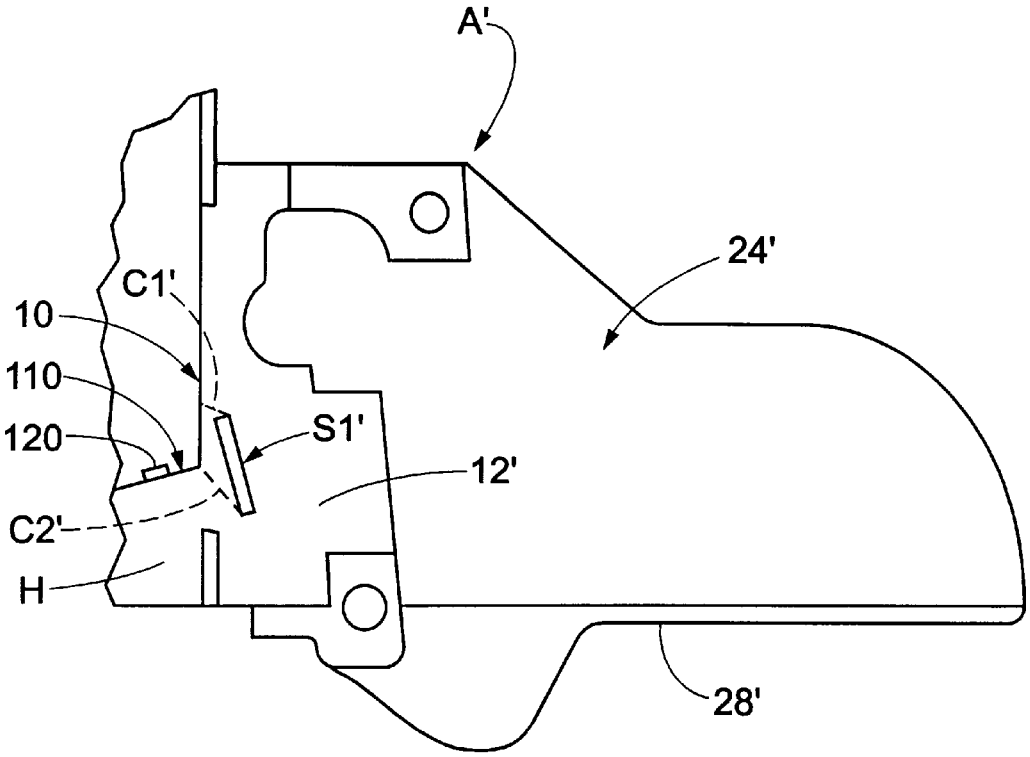
FIG. 9 is a simplified partial side elevational view of a toner cartridge which includes a corona wire grid.

FIG. 9 illustrates a waste toner hoper region A' of a toner cartridge constructed in accordance with, for example, the well known and commercially available IBM 4019 and 4029 toner cartridges. Like components of the cartridge waste hopper region A' relative to the cartridge waste hopper region A are illustrated with like reference numerals including a primed (') suffix for convenient reference. New components are indicated by new reference numerals.

Figure 10:
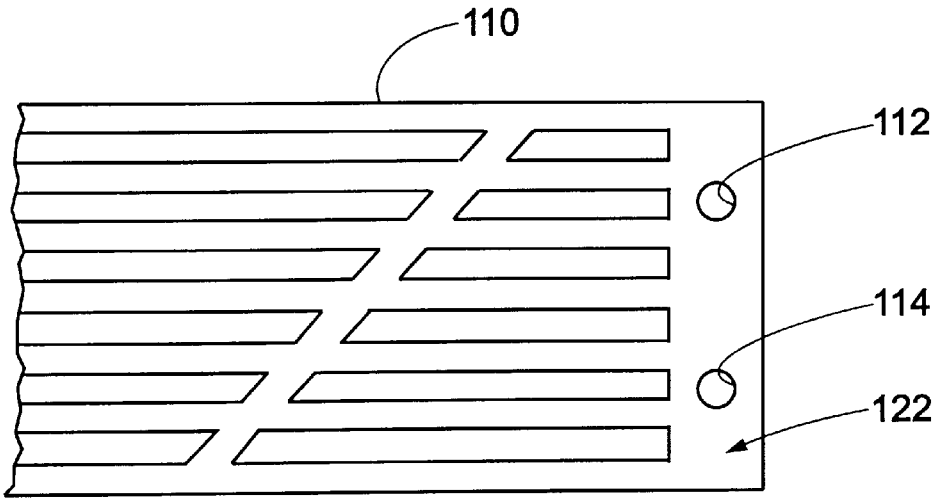
FIG. 10 is a greatly enlarged partial front elevational view of a corona grid removed from the cartridge of FIG. 9.

The waste toner hopper region A' is similar in all respects with the waste toner hopper region A, except that a charge corona grid assembly 110 is secured thereto to achieve uniform charging of the photosensitive drum. With reference also to FIG. 10, the metallic corona grid 110 includes a plurality of attachment apertures 112,114 formed therethrough. As shown, each lateral side of the grid includes two such apertures, although a greater or lesser number of such apertures could also be present. During the manufacture of the waste hopper region A', the grid 110 is secured to the cartridge housing by well known means such as stakes or other fasteners each including a heat-swaged or otherwise deformed upper region 120.

The grid 110 is secured to the cartridge housing H in the region of the wiper blade assembly 10 and prevents the formation of the cuts C1,C2 as described above for removal of the wiper blade assembly. As such, the grid 110 must be removed for removal and replacement of the wiper blade assembly 10 in accordance with the present invention. To remove the grid 110, the deformed upper region 120 of each fastener is chiseled or otherwise removed by convenient means. Once the enlarged region 120 of each grid fastener is removed, the grid is simply lifted from the waste toner hopper region A'.

Following grid removal, the wiper blade assembly 10 of the cartridge waste toner hopper region A' is removed and replaced as described above relative to FIGS. 1–8B. However, the cartridge will not function properly unless the corona grid is replaced and secured to the cartridge housing. Heretofore, it has been difficult and time consuming to secure the grid 110 to the cartridge housing once it has been removed. The apertures 112,114 formed in the grid 110 are very small, and thus require the use of small fasteners that are difficult to handle. Further, any fastener used for grid reattachment must not extend significantly above the grid upper surface 122 where it would interfere with the photosensitive drum.

Figure 11:
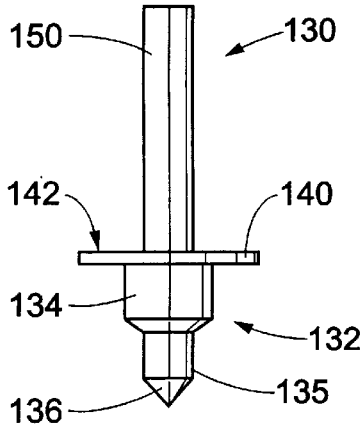
FIG. 11 is an enlarged elevational view of a corona grid fastener armed in accordance with the present invention.
Figure 12A:
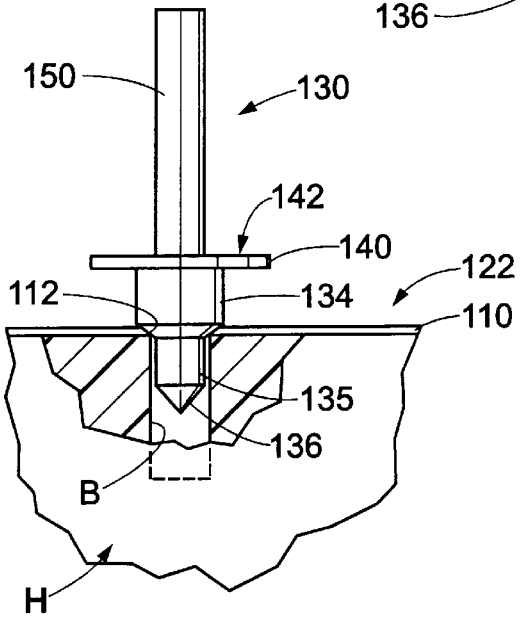
FIG. 12A is an enlarged side elevational view, partially broken away, illustrating the use of the fastener of FIG. 11 to secure a corona grid to a toner cartridge housing.
Figure 12B:
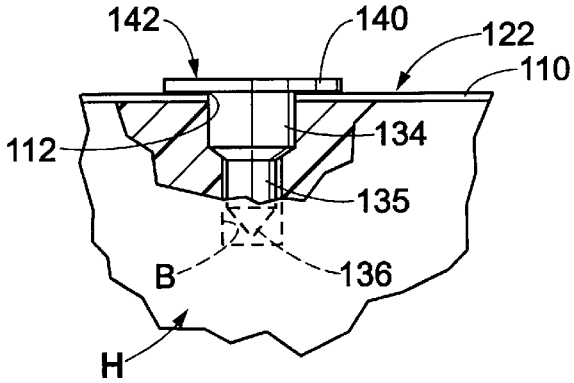
FIG. 12B is an enlarged side elevational view, partially broken away, illustrating the fastener of FIG. 12A after the gripping projection has been removed; and, FIG. 13 is a partial front elevational view of a corona grid fastened to a cartridge housing in accordance with the concept of the present invention.
Figure 13:
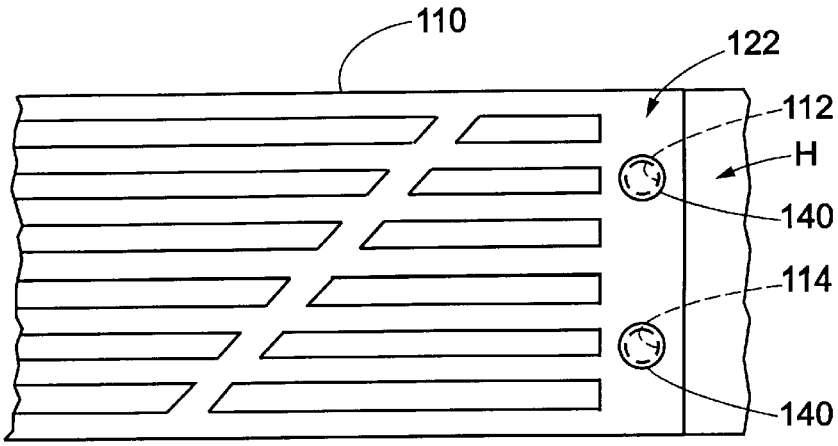

FIGS. 11–13 illustrate a new and improved fastener 130 and its use to secure a corona grid 110 to a waste toner hopper region A' for overcoming the above-noted difficulties. The fastener is preferably molded from any suitable plastic, but other materials may alternatively be used within the spirit and scope of the invention. Also, the relative dimensioning between certain portions of the new fastener, particularly the diameters, has been exaggerated in FIGS. 11 and 12 simply to allow a better understanding and appreciation of the invention.

To secure the corona grid 110 to the housing H, a plurality of fasteners 130, preferably equal in number to the number of fasteners originally used, are advantageously employed. During grid removal, and after the enlarged portion 120 of each original fastener is removed and the grid 110 is lifted from the cartridge region A', the portion of each original fastener remaining in the cartridge housing H is drilled or otherwise removed. Such action thus results in the formation of a plurality of grid attachment bores B (FIG. 12A). In practical application, it has been found conveniently advantageous to remove the enlarged portion of each original fastener 120, and then use the attachment apertures 112,114 as drill guides for precisely locating attachment bores B. In this approach, the grid is not removed from the cartridge until after the drilling has been completed. In any case, when the grid 110 is replaced in the waste hopper region A', each attachment aperture 112,114 will be disposed in registry with one of the bores B.

The fastener 130 includes a lower region 132 for insertion through an aperture 112,114 into the associated bore B in alignment therewith as is shown in FIG. 12A. As shown, the fastener lower portion preferably includes a first cylindrical portion 134 having a diameter substantially equal to or minimally less than the diameter of each aperture 112,114, and slightly larger than each bore B. A second cylindrical portion 135 of the fastener is disposed inwardly adjacent to first portion 134 and merges into a "pointed" or conical lowermost portion 136 to facilitate ease of starting insertion of the fastener end 132 into one of the apertures 112,114 and a corresponding bore B. The diameter of second cylindrical portion 135 is approximately equal to the diameter of associated bore B for reasons and purposes to be described. Moreover, the diameter of bore B is less than the diameter of apertures 112,114 in grid 110, and is also less than the diameter of first cylindrical portion 134.

The fastener 130 includes a radially enlarged flange 140 which is larger in diameter than the apertures 112,114 formed in the grid. As such, the flange limits initial downward movement of the fastener lower end 132 into the bore B and retainingly engages the grid upper surface 122 as will be described. Once the fastener lower end 132 is secured in the bore B, the flange thus prevents movement of the grid 110 away from the housing H.

The fastener 130 further includes a gripping projection 150 extending outwardly from the flange upper surface 142 in a direction normal thereto. The gripping projection is provided solely for human or machine grasping of the fastener to better accommodate its insertion into a bore B as described. As shown, the projection is in the form of a cylindrical shaft, however, those skilled in the art will recognize that gripping projection 150 may take any of a wide variety of other forms without departing from the overall intent or scope of the present invention.

Prior to fastener installation, a volume of suitable adhesive, such as acrylonitrile-butadiene-styrene (ABS) adhesive or the like, is introduced into the bore so that end 132 of a fastener inserted therein may be securely bonded to the wall of the bore. The fastener lower portion 132 is inserted through an aperture 112,114 into the associated bore B. Because of the dimensional relationships described above, the fastener is readily received in bore B up to the area of merger between second and first cylindrical portions 135,134, but such insertion is at least sufficient to properly locate grid 110 in a mounted position. The gripping projection 150 is then cut or otherwise removed from the fastener 130. Preferably, such removal is flush with the flange upper surface 142 in the manner illustrated in FIG. 12B, and thus ensures that the remaining portions of the fastener will not interfere with the adjacent photosensitive drum. Finally, at that point, each fastener may be tapped or otherwise forcibly inserted by convenient means further through its associated aperture 112,114 and into its associated bore B. The relative dimensioning between the components as described above thus results in an interference or force fit between each fastener first cylindrical portion 134 and its associated bore B. Although the diameters of first and second cylindrical portions 134,135 have been exaggerated in the FIGURES, a difference in diameters of approximately 0.003" may typically be involved. Such fit, along with the previously applied adhesive, results in a secure remounting of the grid 110.

The invention has been described with reference to preferred embodiments obviously, modifications and alterations will occur to others upon a reading and understanding of the preceding specification. It is intended that the invention be construed as including all such modifications and alterations insofar as they fall within the scope of the appended claims or equivalents thereof.

Having thus described the preferred embodiments, the invention is claimed to be:

1. A clip for fixedly securing a wiper blade assembly in an operative position relative to an associated toner cartridge, said clip comprising:

a base member defining an inner surface for lying adjacent a first portion of a sidewall of said associated toner cartridge;

a first projection extending outwardly from a first end of said base member inner surface for engaging said wiper blade assembly and securing said wiper blade assembly adjacent said cartridge sidewall, said first projection including a lateral inner surface generally transverse to said base member; and, a second projection extending outwardly from a second end of said base member inner surface opposite said first projection and including an inner sidewall engaging surface generally opposed to said lateral inner surface of said first projection, said inner sidewall engaging surface of said second projection inclined relative to said lateral inner surface of said first projection so as to be positioned for engaging a second portion of said cartridge sidewall, said first and second projections resiliently biased inward toward each other.

2. The wiper blade securing clip as set forth in claim 1 wherein said lateral inner surface of said first projection extends between first and second edges of said base member, and wherein said inner sidewall engaging surface of said second projection extends between said first and second edges of said base member.

3. The wiper blade securing clip as set forth in claim 1 wherein said second projection comprises:

at least one lance projecting outwardly from said inner sidewall engaging surface thereof for biting engagement with said second portion of said cartridge sidewall upon connection of said clip to said cartridge.

4. The wiper blade securing clip as set forth in claim 1 further comprising:

a third projection extending outwardly from said base member between said first and second projections, said third projection including an inner surface arranged transverse to both said lateral inner surface of said first projection and said inner sidewall engaging surface of said second projection so that said inner surface of said third projection is positioned to engage a third portion of said cartridge sidewall generally perpendicular to said first and second cartridge sidewall portions.

5. The wiper blade securing clip as set forth in claim 1, wherein said clip is fabricated as a one-piece metallic construction.

6. A clip for securing a wiper blade assembly in an operative position relative to an associated toner cartridge, said clip comprising:

a base member defining a base inner surface for lying adjacent a first portion of a sidewall of said associated toner cartridge;

a first projection extending outwardly from a first end of said base inner surface, said first projection including a first inner surface generally transverse to said base member for engaging said wider blade assembly and securing said wiper blade assembly adjacent said cartridge sidewall; and, a second projection extending outwardly from a second end of said base inner surface opposite said first projection and including a second inner surface generally opposed to said first inner surface for engaging a second portion of said cartridge sidewall, said first and second projections resiliently biased inward toward each other and spreadable relative to each other, said second projection further defining a distal end turned outwardly away from said second inner surface to facilitate connection of said clip to said cartridge.

7. A clip for fixedly securing a wiper blade assembly in an operative position relative to a toner cartridge, said clip comprising:

a base member defining a base inner surface for lying adjacent a first portion of a sidewall of said cartridge, said base inner surface including first and second opposite ends, and first and second spaced-apart edges that extend between the first and second opposite ends on opposite lateral sides of said base inner surface;

a first projection extending outwardly from said first end of said base inner surface, said first projection including a first inner surface generally transverse to said base member for engaging said wiper blade assembly and securing said wiper blade assembly adjacent said cartridge sidewall;

a second projection extending outwardly from said second end of said base inner surface and including a second inner surface, generally opposed and inclined relative to said first inner surface, for engaging a second portion of said cartridge sidewall, said first and second projections resiliently biased inward toward each other; and, a third projection extending outwardly from the first edge of said base member between said first and second projections, said third projection including a third inner surface for engaging a third portion of said cartridge sidewall generally perpendicular to said first and second cartridge sidewall portions.

* * * * *